United States Patent [19]

Witkin

[11] 4,341,024

[45] Jul. 27, 1982

[54] TUBE DRYER ASSEMBLY

[76] Inventor: Philip M. Witkin, 110 Lowood La., Greenville, S.C. 29605

[21] Appl. No.: 168,535

[22] Filed: Jul. 14, 1980

[51] Int. Cl.[3] ..... F26B 13/02

[52] U.S. Cl. ..... 34/155; 34/156; 34/225; 226/97

[58] Field of Search ..... 34/155, 156, 224, 225; 226/97; 432/159, 194

[56] References Cited

U.S. PATENT DOCUMENTS

| | | | |
|---|---|---|---|
| 2,294,161 | 8/1942 | Crowe | 34/54 |
| 3,041,739 | 7/1962 | Windhorst | 34/156 |
| 3,793,741 | 2/1974 | Smith, Jr. | 34/155 |
| 3,964,656 | 6/1976 | Hella | 34/156 |

*Primary Examiner*—Larry I. Schwartz

[57] ABSTRACT

A tube dryer is illustrated wherein a plurality of spaced tubes extend outwardly from a plenum to direct heated air against material passing thereby on a conveyor. The tubes are connected by inverted substantially channel-shaped members transversely disposed across the material being heat treated. The channel-shaped members have a web portion in a plane parallel to the conveyor with the tubes extending through the web member. The web member affords support for the tubes insuring their proper positioning to direct air for accurate impingement upon the material such as fabric or a layer of particulate material passing thereby and prevents snagging of the conveyor or the material carried thereby against the ends of the tube.

3 Claims, 3 Drawing Figures

TUBE DRYER ASSEMBLY

BACKGROUND OF THE INVENTION

Tube dryers have been provided in the prior art in many configurations such as those illustrated in U.S. Pat. Nos. 3,060,595, 3,199,224, 3,262,217, 3,525,164, 3,199,213, 4,109,394 and 4,139,648. The prior art includes a jet tube dryer especially suited to the drying of flat layers of particulate material manufactured by Martin Processing, Inc. of Martinsville, Va. Dryers constructed in accordance with such prior art have disadvantages in that the free ends of the tubes are unsupported so that the tubes become easily misaligned due to dislodgement so that the pattern of the air being directed by the tubes is distributed thereby, in the case of fabric, causing uneven drying which would result in streaking. It is important therefore, that the tubes remain in alignment at all times so that as the material passes by the array of tubes at least one or more tubes are arranged to be directed against a particular longitudinal portion of the material passing thereby for drying. The proper patterns of air directed against the longitudinally moving material must insure even drying entirely thereacross.

An advantage of tube dryers resides in the fact that the tubes provide ample space for a cross-flow of air for return for being again heated without interferring with the impinging air flow. A particular advantage of tubular dryers constructed in accordance with the invention resides in the fact that the cross-flow is implemented whereas the heated air is held in impinging relation with the material to be dried for a substantially longer period of time.

Should the conveyed material such as cloth or fabric become excessively relaxed or slack, there is a possibility that such can be caught on the tubes and when this occurs the tubes become dislodged due to such snagging with damage to the oven. It is important that the air be applied in regular patterns and retained as long as possible near the fabric to permit the useful heat to be dissipated and utilized in the drying operation.

It is thus seen that an important object of the invention is to prevent streaking which occurs as a result of two things, one, if there is a large flow of air across the oven, past the impinging jets, the tubes permit free area for flow in order to avoid excessive disturbance of the impinging jets and this is facilitated by the structure of assemblies constructed in accordance with the invention. Secondly, the jets themselves must, since each one directs air at the fabric in a given area even distribution of such areas all across the fabric as it goes down the oven and should one of these tubes come out of alignment some areas of the fabric might get subjected to a double drying action and some none at all with streaking occurring as a result.

SUMMARY OF THE INVENTION

It has been found that a tube dryer assembly may be provided for supporting the free ends of the tubes of a tube dryer while insuring impingement of heated air against the material to be dried for a maximum length of time while providing ample room for cross-flow of air thereby insuring uniform drying and avoiding streaking by providing a plurality of longitudinally spaced transverse flat web members horizontally disposed bridging the free ends of the tubes which project through the web members. The web members have depending stiffening sides in the form of legs providing a substantially channel-shaped member. The channel-shaped members are longitudinally bridged adjacent their ends and mounted on suitable support means upon the longitudinal plenums or transverse portions thereof.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The drawings illustrate an elongated oven and the like for subjecting flat material moving therethrough on conveyor means to the action of heated air. An improved tube assembly includes a pair of plenums A spaced vertically with the flat material on conveyor means moving therebetween. A plurality of longitudinally spaced rows of transversely spaced tubes B extend from the plenums for carrying heated air from the plenums inwardly toward the conveyor. A plurality of longitudinally spaced inverted channel-shaped members C have web portions with transversely spaced openings therein for accommodating an open discharge end of said tubes therein for discharging heated air from the tubes therethrough against said flat material. Marginal longitudinal stiffener members D interconnect end portions of said channel-shaped members. Longitudinally spaced support means E are fixed upon the plenums on one end and carry the stiffeners on the other end thereof.

Figure 1:
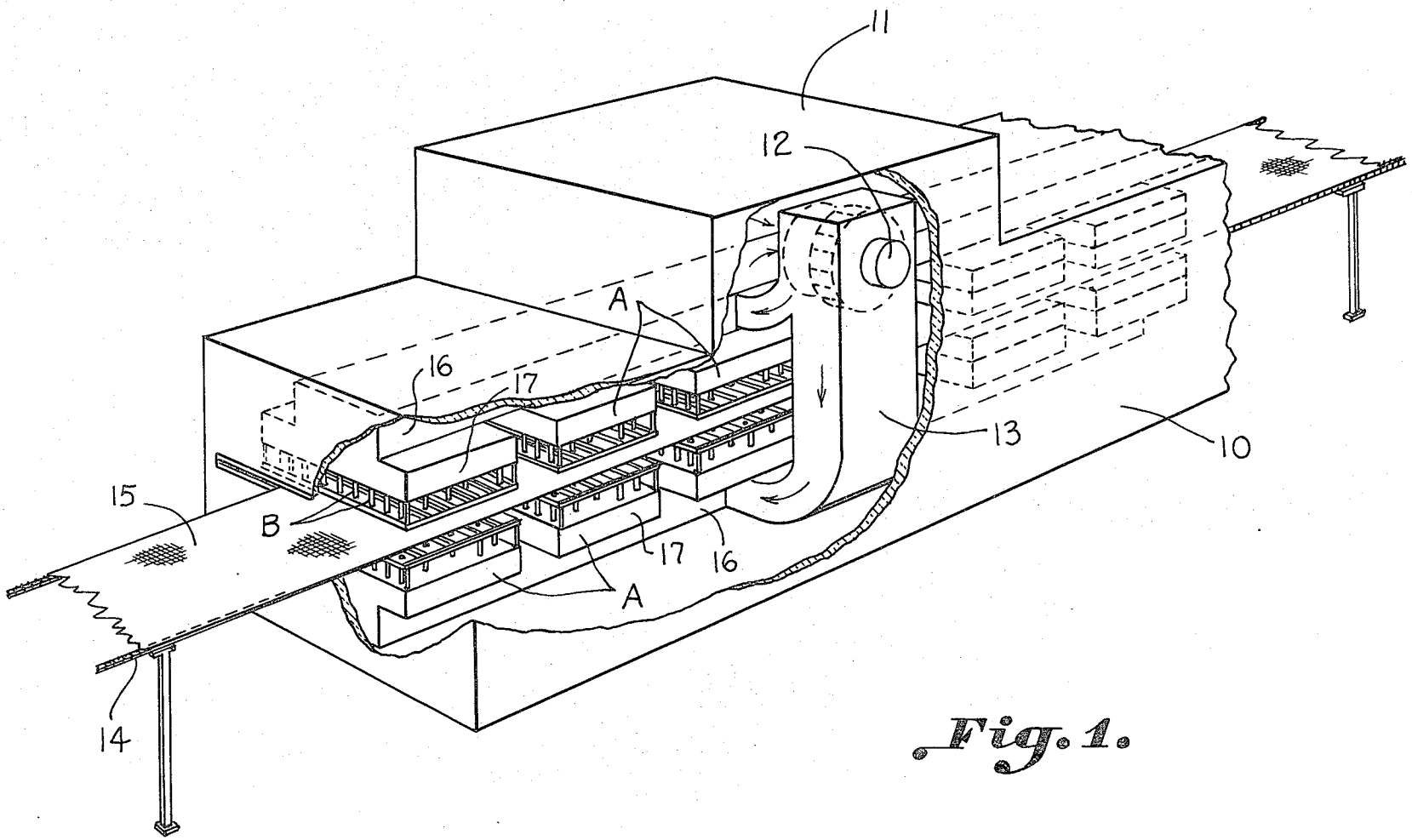
FIG. 1 is a perspective view illustrating a portion of a range having a penthouse for providing heated air with a plenum having tube dryer assemblies constructed in accordance with the invention.

Referring now especially to FIG. 1, the walls of an oven having a substantially rectangular cross-section are illustrated at 10. A number of spaced penthouses 11 are positioned in the usual fashion atop the walls of the oven and afford a means for producing heated air which is conveyed by the fans 12 downwardly through the duct member 13 and into the upper and lower plenum arrangments designated at A. The material to be dried is illustrated as being supported by a conveyor having the usual tenter chains 14 carrying suitable means such as pins or grippers (not shown) for supporting the selvage portions of the cloth or fabric 15.

Figure 2:
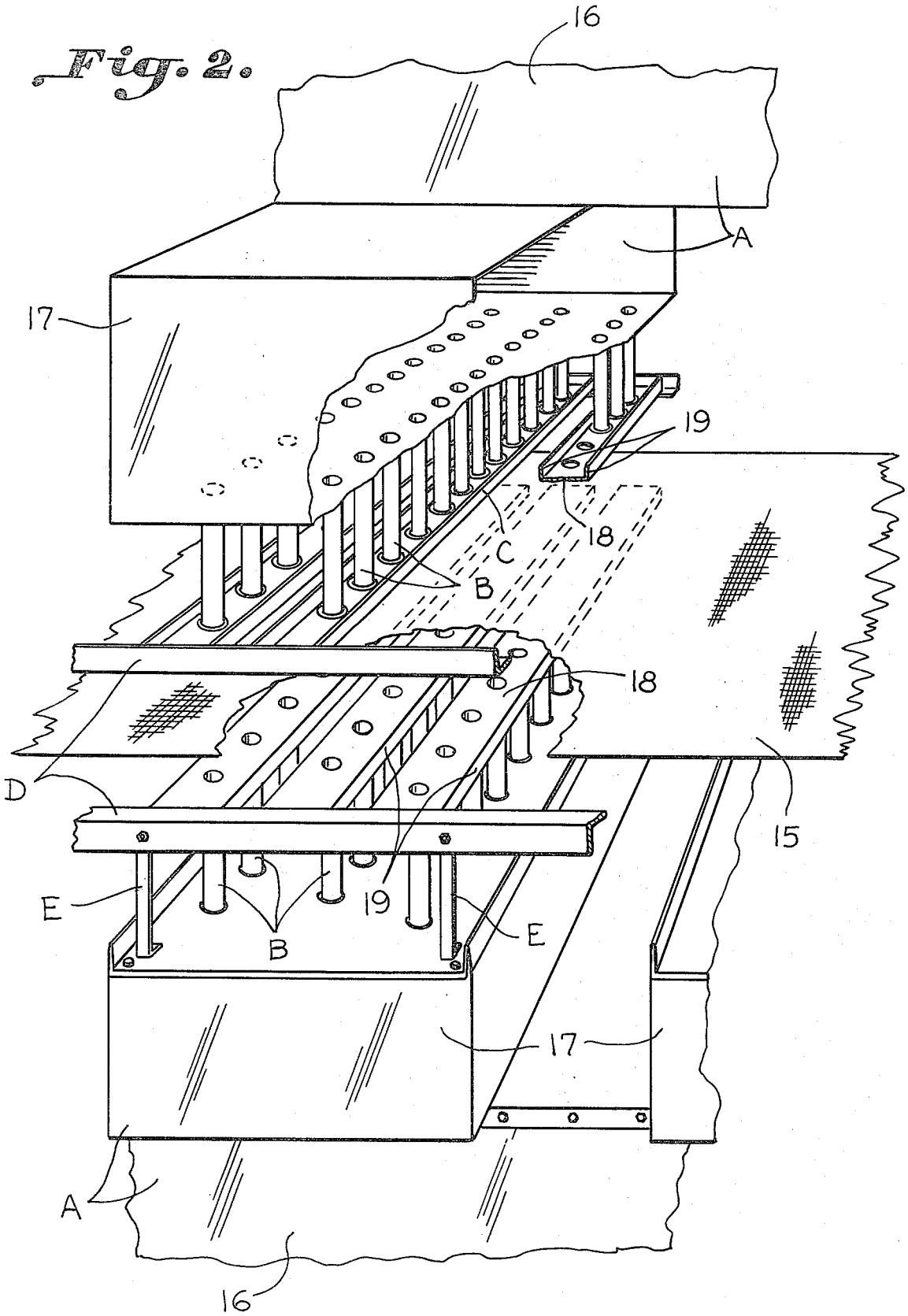
FIG. 2 is an enlarged perspective view illustrating the tubular tube dryer assembly constructed in accordance with the present invention with fabric passing between several arrays of upwardly and downwardly extending tubes.

Referring more particularly to FIGS. 1 and 2, it will be observed that the plenum means A includes at least one longitudinally directed plenum portion 16 which supplies air to the transverse horizontal plenum portions 17 from which the array of tubular members B extend toward the fabric 15 for drying. It will be observed that the tubes extend downwardly from such a transverse plenum portion 17 at the top and upwardly from a similar opposed transverse plenum portion 17 at the bottom toward the lower surface of the fabric. The tubular members B are illustrated as being spaced and each of them at a free end extends through a web member 18 of one of the channel-shaped members. The web member has a leg or flange portion 19 carried at each side thereof extending transversely across the assembly. At the ends of one of the modules or tube assemblies, a longitudinal stiffener member D is illustrated in the form of an angle. The marginal supports D are carried by vertical support members in the form of standards E, which are suitably secured to the stiffeners on one end and to the plenum portions 17 at the other end. Any number of longitudinally spaced rows of any member of transversely spaced tubes may be employed, there being five rows shown in FIG. 1, while three rows are shown in FIG. 2.

Figure 3:
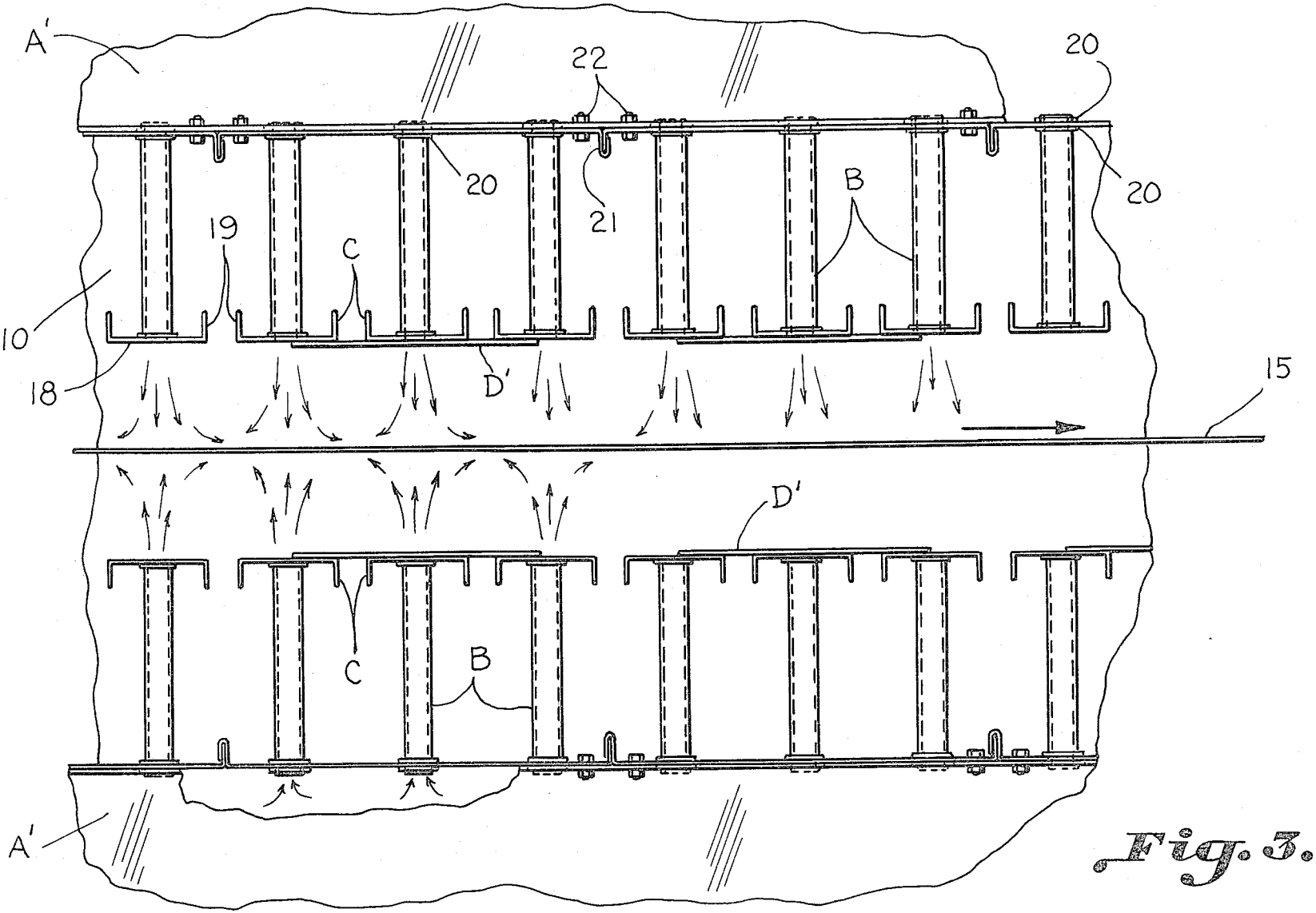
FIG. 3 is an enlarged longitudinal sectional view illustrating a tube dryer assembly constructed in accordance with or modified form of the present invention positioned upon a continuous longitudinal plenum having tubes extending from a longitudinal portion thereof.

FIG. 3 illustrates a somewhat modified form of the invention wherein longitudinal plenums which extend across the oven with one plenum above and one plenum below the fabric are illustrated at A'. A plate D' is provided extending across end portions of the channel members C to act as stiffeners. Since the tubes themselves when so interconnected act as brackets or supports for other tubes so connected, the end support members E may be eliminated. The remaining parts are designated by like reference characters. The details of the attachment of the tubes to the depending plenum walls include the use of lock washers 20. It will be observed that the plenum is constructed of sheet metal which have overlying fastening portions forming seams 21 with suitable fasteners in the form of bolts illustrated at 22.

It is thus seen that the tube dryer assemblies may be provided which are especially suited for retrofitting upon existing ovens. Since the tubes are supported, snagging of fabric sagging against tube ends is avoided while accurate patterning of air discharge jets is assured. At the same time air is retained a maximum time for contact with the fabric and return flow thereof is facilitated.

While a preferred embodiment of the invention has been described using specific terms, such description is for illustrative purposes only, and it is to be understood that changes and variations may be made without departing from the spirit or scope of the following claims.

What is claimed is:

1. For use in an elongated oven and the like for subjecting flat material moving therethrough on conveyor means to the action of heated air;

an improved tube assembly comprising:

a pair of plenums spaced vertically with said flat material on conveyor means moving therebetween;

a plurality of longitudinally spaced rows of transversely spaced tubes of substantially equal length extending from said plenums for carrying heated air from the plenums inwardly toward said conveyor means;

said tubes having connection on one end thereof with a respective plenum for receiving heated air and extending outwardly thereof toward said flat material;

a plurality of longitudinally spaced inverted channel-shaped members having web portions with transversely spaced openings therein for accommodating and securing said tubes adjacent an open discharge end, opposite said one end, of said tubes therein for discharging heated air from the tubes of substantially equal length therethrough against said flat material, said plurality of longitudinally spaced inverted channel-shaped members providing spaced openings to accomodate airflow between said channel-shaped members, and said tubes being substantially unsupported between said connection on said one end and said channel-shaped members on said open discharge end of said tubes; and marginal longitudinal stiffener members interconnecting end portions of said channel-shaped members.

2. The structure set forth in claim 1 including longitudinally spaced support means fixed upon said plenums on one end and carrying said stiffeners on the other end thereof.

3. A tube dryer and the like for treating flat material comprising:

an elongated hot air plenum;

a plurality of spaced tubular members of substantially equal length projecting vertically outwardly from said plenum having fixed connection with said plenum on one end thereof for receiving hot air from said plenum and extending outwardly thereof toward said flat material;

a conveyor carrying said material in a layer past an open end of said tubular members for impingement of heated air from said tubular members thereon;

a plurality of flat web members horizontally disposed in longitudinally spaced relation to each other having transversely spaced openings therein for receiving and securing said tubes adjacent a discharge end of said tubular members opposite said plenum and said one end thereof said plurality of flat web members providing spaced openings to accommodate airflow between said flat web members, and said tubular members being substantially unsupported between said connection on said one end and said flat web members on said discharge end of said tubular members; and depending flanges carried by said web members extending toward said plenum.

* * * * *